US012492604B1

(12) United States Patent
Shammari et al.

(10) Patent No.: US 12,492,604 B1
(45) Date of Patent: Dec. 9, 2025

(54) BACK PRESSURE VALVE RECOVERY TOOL AND METHODS OF USE

(71) Applicant: SAUDI ARABIAN OIL COMPANY, Dhahran (SA)

(72) Inventors: Farhan H. Shammari, Dammam (SA); Shaker M. Halawie, Dammam (SA); Mohammed M. Qethi, Ras Tanura (SA); Hamed M. Nafa, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/738,494

(22) Filed: Jun. 10, 2024

(51) Int. Cl.
*E21B 31/06* (2006.01)
*E21B 31/20* (2006.01)

(52) U.S. Cl.
CPC ..... *E21B 31/06* (2013.01); *E21B 31/20* (2013.01)

(58) Field of Classification Search
CPC ..... E21B 31/06; E21B 31/20
See application file for complete search history.

(56) References Cited

U.S. PATENT DOCUMENTS

| | | | | | |
|---|---|---|---|---|---|
| 1,310,169 | A * | 7/1919 | Westcott | E21B 31/20 | 294/86.32 |
| 2,771,957 | A * | 11/1956 | Weber | E21B 31/20 | 279/2.12 |
| 2,887,162 | A * | 5/1959 | Le Bus, Sr. | E21B 31/00 | 294/86.34 |
| 5,605,366 | A * | 2/1997 | Beeman | E21B 31/20 | 294/86.15 |
| 5,639,135 | A * | 6/1997 | Beeman | E21B 31/20 | 294/86.15 |
| 10,156,122 | B2 | 12/2018 | Nguyen et al. | | |
| 2012/0298376 | A1* | 11/2012 | Twardowski | E21B 31/20 | 166/242.6 |
| 2014/0332234 | A1* | 11/2014 | Hallundb | E21B 23/02 | 166/242.6 |
| 2018/0106128 | A1* | 4/2018 | Nguyen | E21B 33/04 | |

* cited by examiner

*Primary Examiner* — David Carroll
(74) *Attorney, Agent, or Firm* — Vorys, Sater, Seymour and Pease, LLP

(57) ABSTRACT

A back pressure valve recovery tool includes an elongate, cylindrical body having opposing upper and lower ends, and a matable feature provided at the lower end and matable with an inner profile provided on an upper end of a broken section of a back pressure valve (BPV) retrieval tool. The broken section of the BPV retrieval tool is received within a back pressure valve installed within a wellhead.

19 Claims, 3 Drawing Sheets

BACK PRESSURE VALVE RECOVERY TOOL AND METHODS OF USE

FIELD OF THE DISCLOSURE

The present disclosure relates generally to back pressure valve (BPV) retrieval tools and, more particularly, to a BPV recovery tool operable to retrieve a broken section of a BPV retrieval tool stuck in a back pressure valve.

BACKGROUND OF THE DISCLOSURE

Throughout the lifetime of an oil and gas well, proper sealing and pressure isolation equipment is required to prevent undesirable fluid flow out of the system, including oil, gas, injection fluids, formation water, or a combination thereof. One common mechanical barrier utilized in sealing a wellhead of an oil and gas well is a back pressure valve (BPV). The BPV is typically secured within a specially machined profile in the bore of a tubing hanger, and the tubing hanger is arranged within a tubing head adapter forming part of the wellhead or wellhead installation. A production tree (alternately referred to as a "Christmas tree") is commonly attached to the top of the tubing head adapter to control flow into and out of the wellbore extending from the wellhead.

The BPV operates as a one-way check valve designed to isolate the well pressure from below while enabling at least a small amount of fluid to flow from above; i.e., from the Christmas tree. In some applications, for example, and depending on design, the BPV can allow pumping through the tubing to kill any undesired flow or pressure. Moreover, the BPV allows for the safe exchange or repair of valves included in the wellhead and Christmas tree without lengthy and costly kill operations to eliminate well pressure. Furthermore, the BPV can also provide well control at certain stages of completion and de-completion operations, as well as an extra level of safety when potential surface damage to the Christmas tree or wellhead exists.

BPVs are normally retrieved with a specially designed retrieval tool connected to a running tool or "tool string," which is run and controlled hydraulically to set within a BPV profile. BPV retrieval tools can pose significant challenges, especially when the retrieval tool becomes stuck within the wellhead. In some scenarios, for example, a retrieval tool can be severed from the tool string after being subjected to large amounts of torque, and thereby leave a broken part or section of the retrieval tool latched in the BPV profile. In such scenarios, a well operator will typically attempt to mill out the broken tool inside the BPV. Such milling operations, however, are time-consuming and can often take days or even weeks to complete. Moreover, such milling operations require specialized equipment and expertise, making them expensive and difficult to organize.

Stuck BPV retrieval tools can create a range of problems for oil and gas operations, such as wellbore inaccessibility, losing a crucial means of well control and securement, production delays, and increased expenses. The problem of stuck BPV retrieval tools is exacerbated by the fact that many of these tools are expensive and difficult to replace. Even a single instance of a tool being stuck may lead to significant costs and delays for oil and gas operations.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a back pressure valve recovery tool is disclosed and includes an elongate, cylindrical body having opposing upper and lower ends, and a matable feature provided at the lower end and matable with an inner profile provided on an upper end of a broken section of a back pressure valve (BPV) retrieval tool, wherein the broken section of the BPV retrieval tool is received within a back pressure valve installed within a wellhead.

According to an embodiment consistent with the present disclosure, a method for retrieving a broken section of a back pressure valve (BPV) retrieval tool is disclosed and includes the steps of lowering a back pressure valve (BPV) recovery tool into a wellhead having a back pressure valve installed therein and a broken section of the BPV retrieval tool received within the back pressure valve, the BPV recovery tool including an elongate, cylindrical body having opposing upper and lower ends, and a matable feature provided at the lower end and matable with an inner profile provided on an upper end of the broken section of the BPV retrieval tool. The method further including the steps of upon reaching the broken section of the BPV retrieval tool, rotating the BPV recovery tool until the matable feature is received within the internal profile, rotating the BPV recovery tool to transfer torque from the BPV recovery tool to the broken section of the BPV retrieval tool, and thereby separating the BPV retrieval tool from the back pressure valve, and removing the BPV recovery tool and the BPV retrieval tool from the wellhead.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
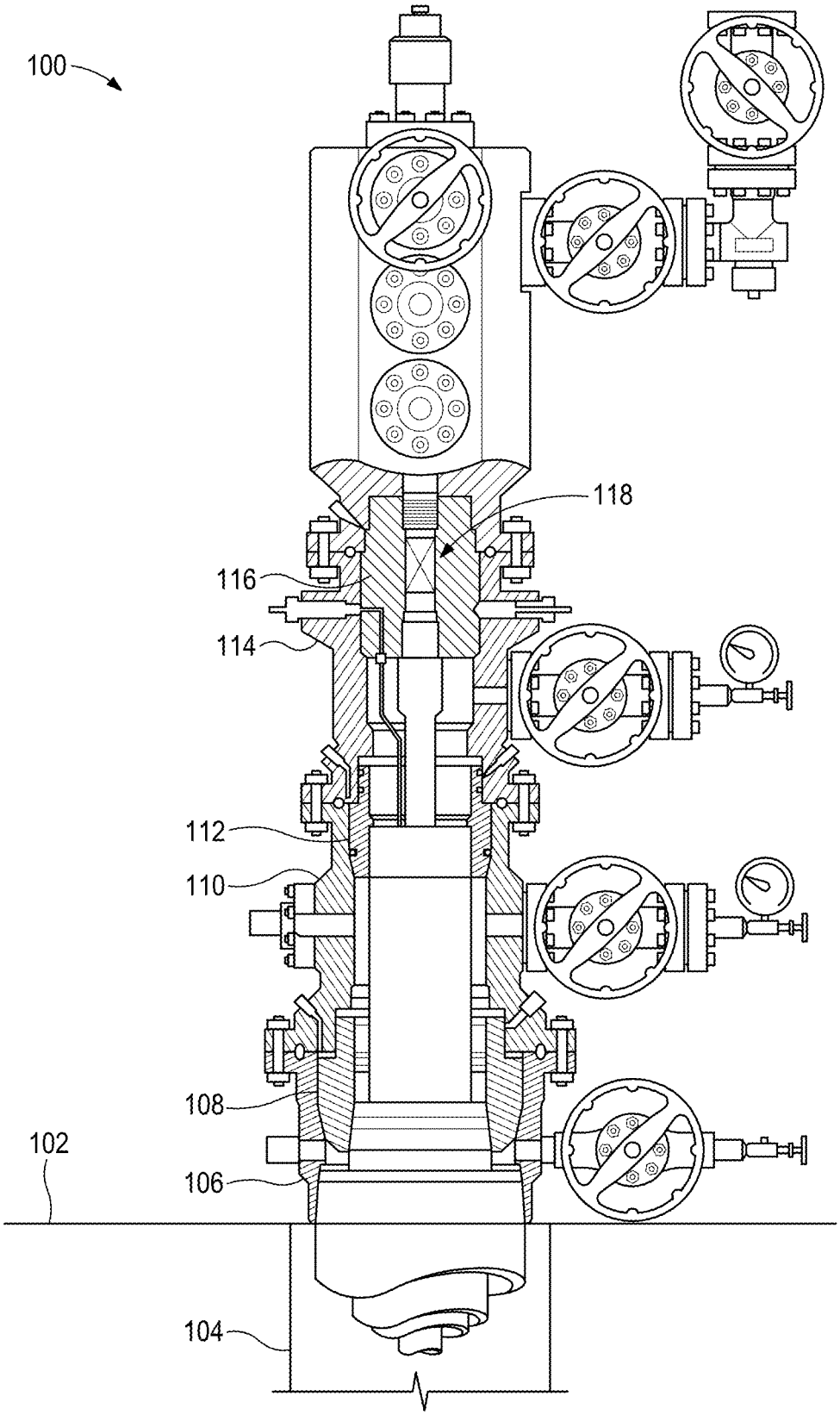
FIG. 1 depicts a schematic view of an example wellhead that may be used in accordance with the principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to a back pressure valve (BPV) retrieval tools, and BPV recovery tools operable to retrieve stuck BPV retrieval tools. The BPV recovery tools described herein can be run into a wellhead using the same running tool and tool string used to convey a BPV retrieval tool, and may provide a matable feature configured to locate and mate with an internal profile of a severed section of the BPV retrieval tool that remains stuck in a back pressure valve. In some embodiments, the matable feature may exhibit a hexagonal cross-section configured to locate and mate with a corresponding hexagonal cross-section of the internal profile of the BPV retrieval tool. As further described herein, in some embodiments, the BPV recovery tool may exhibit magnetic properties capable of magnetically attracting ferromagnetic materials, such as the broke section of the BPV retrieval tool. Consequently, the BPV recovery tool may be able to release the BPV retrieval tool from the BPV, and simultaneously pull the BPV retrieval tool from the wellhead via magnetic interaction all in the same run into the wellhead.

FIG. 1 depicts a schematic view of an example wellhead 100 that may be used in accordance with the principles of the present disclosure. The wellhead 100 may be arranged at a well surface location 102 (e.g., land based, floating platform, subsea, etc.) and a wellbore 104 extends from the wellhead 100 and penetrates one or more subterranean formations. The wellhead 100 helps facilitate hydrocarbon production from the well, but also provides a means of introducing downhole tools and fluids into the wellbore 104.

As illustrated, the wellhead 100 includes a casing head housing 106 with a casing hanger 108 secured therein. The wellhead 100 may further includes a casing head 110 secured to the top of the casing head housing 110, and a casing hanger 112 may be secured within the casing head housing 110. The wellhead 100 further includes a tubing head adapter 114 which is secured to the top of the casing head housing 110, and a tubing hanger 116 which is secured within the tubing adapter 114. In the illustrated figure, a back pressure valve or "BPV" 118 (generically shown as a box) is received within the tubing hanger 116 and, more particularly, within a specially machined profile within the bore of the tubing hanger 116. The BPV 118 may comprise, for example, a type-H back pressure valve that is threaded into a corresponding threaded interface (profile) of the tubing hanger 116. In other embodiments, however, the BPV 118 may be installed in a plug bushing or the like forming part of the wellhead 100.

Once installed, the BPV 118 helps prevent the escape of well fluids or gases from the wellbore 104 to the surrounding environment. The BPV 118 is an essential component for maintaining well control during production and well completion/stimulation operations, thereby preventing uncontrolled releases of well fluids or gases that could endanger personnel and the environment.

As needed, the BPV 118 may be installed and removed from the wellhead 100 using a BPV retrieval tool (not shown) operatively coupled to a corresponding running tool and associated tool string. The BPV retrieval tool is run into the wellhead 100 connected to the running tool and controlled hydraulically to set the BPV 118 in a profile provided in the wellhead 100; e.g., a threaded interface (profile) of the tubing hanger 116. As desired, the BPV 118 may be removed from the wellhead 100 by again running the BPV running tool into the wellhead 100, mating the BPV retrieval tool with the BPV 118, disengaging the BPV 118 from the wellhead 100, and extracting the BPV 118 as coupled to the BPV running tool. In some removal operations, however, the BPV retrieval tool can break or otherwise be severed upon assuming large axial and/or torsional loads. In such a scenario, a broken or severed portion of the BPV retrieval tool may be left within the BPV 118 as the running tool and the remaining portions of the PBV retrieval tool are retracted from the wellhead 100.

According to embodiments of the present disclosure, a back pressure valve (BPV) fishing or "recovery" tool is disclosed and operable to locate and extract a broken or severed BPV retrieval tool from the wellhead 100 and, more particularly, from engagement with the BPV 118. The BPV recovery tool may be run into the wellhead 100 with the same tool string and running tool as the BPV retrieval tool and may exhibit an external profile (i.e., matable feature) configured to mate with an internal profile of the broken/severed BPV retrieval tool. In some embodiments, the distal end of the BPV recovery tool may also exhibit magnetic properties that allows the BPV recovery tool to magnetically attract the BPV retrieval tool to ensure retrieval of the BPV retrieval tool once disengaged from the BPV and as the BPV recovery tool is retracted from the wellhead.

Figure 2A:
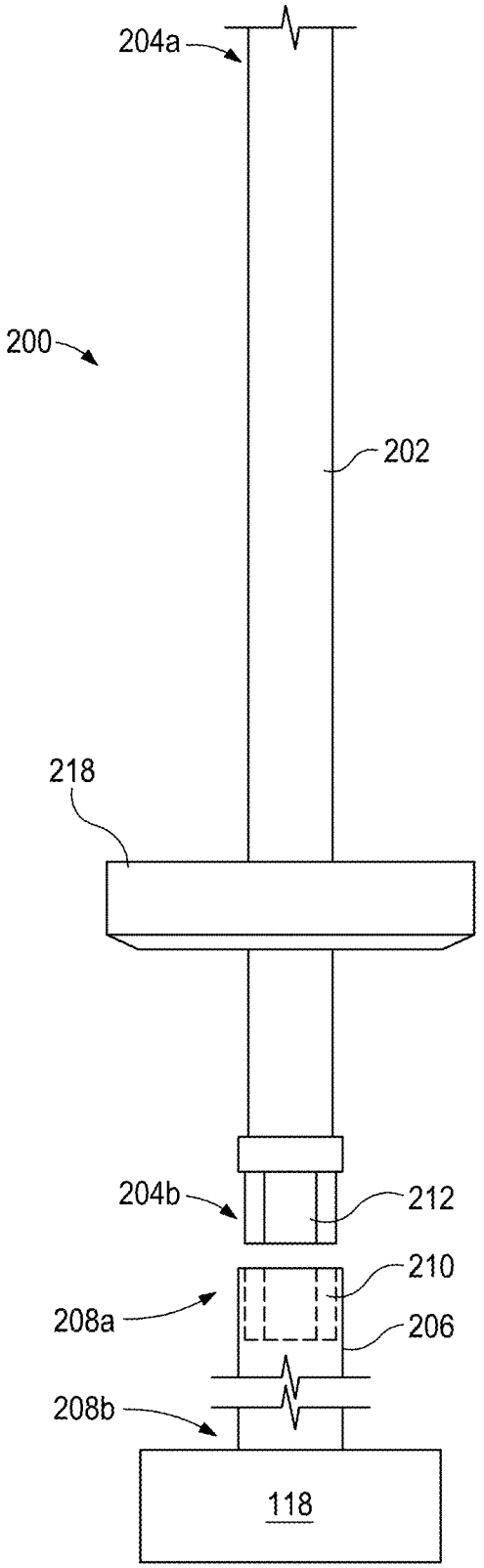
FIG. 2A is a schematic side view of an example back pressure valve recovery tool, according to one or more embodiments of the present disclosure.

FIG. 2A is a schematic side view of an example back pressure valve (BPV) recovery tool 200, according to one or more embodiments of the present disclosure. As illustrated, the BPV recovery tool 200 includes an elongate, cylindrical body 202 having a first or "upper" end 204*a* and a second or "lower" end 204*b* opposite the upper end 204*a*. The upper end 204*a* may be configured to be operatively coupled to a tool string or running tool (not shown) operable to convey the BPV recovery tool 200 into and out of the wellhead 100 (FIG. 1). In at least one embodiment, the upper end 204*a* may be threaded and configured to threadably engage corresponding threaded portions of the running tool. In other embodiments, however, the upper end 204*a* may be operatively coupled to the running tool in other conventional ways.

The lower end 204*b* of the body 202 may be configured to locate and engage a broken section or portion of a BPV retrieval tool 206 operatively coupled to the BPV 118. As described above, the BPV 118 may be installed (set) within the wellhead 100 (FIG. 1) using the BPV retrieval tool 206, which may also be used to subsequently retrieve the BPV 118. As illustrated, the BPV retrieval tool 206 may have a first or "upper" end 208*a* and a second or "lower" end 208*b* opposite the upper end 208*aa*. The lower end 208*b* may be operatively coupled to the BPV 118, such as via a threaded engagement or the like.

In the illustrated embodiment, the upper end 208*a* of the BPV retrieval tool 206 may be broken or otherwise severed from upper portions (not shown) of the BPV retrieval tool 206, which have been removed by reversing (retracting) the running tool from the wellhead 100 (FIG. 1). As indicated above, in some applications, the BPV retrieval tool 206 may be broken or severed upon assuming large torsional and/or axial loads associated with attempting to remove the BPV 118 from the wellhead 100. As a result, a lower portion of the BPV retrieval tool 206 remains attached (stuck) to the BPV 118 at the lower end 208*b*, and the broken (severed) upper end 208*a* may be exposed and otherwise open-ended.

As illustrated, the upper end 208*a* may provide or otherwise define an internal profile 210 configured to receive and mate with the lower end 204*b* of the BPV recovery tool 200. More specifically, in some embodiments, the lower end 204*b* of the BPV recovery tool 200 may provide a matable feature 212 sized and otherwise configured to locate and be received within the internal profile 210 of the BPV retrieval tool 206. In some embodiments, as illustrated, the matable feature 212 may exhibit a polygonal cross-section and the internal profile 210 may exhibit a corresponding polygonal cross-section sized to receive the matable feature 212. In such embodiments, for example, the matable feature 212 may exhibit a hexagonal cross-section and the internal profile 210 may provide a corresponding hexagonal cross-section that receives the matable feature 212 as shown in FIG. 2C. In other embodiments, however, matable feature 212 may be configured to releasably mate with the internal profile 210 via a bayonet connection, or the like.

Figure 2B:
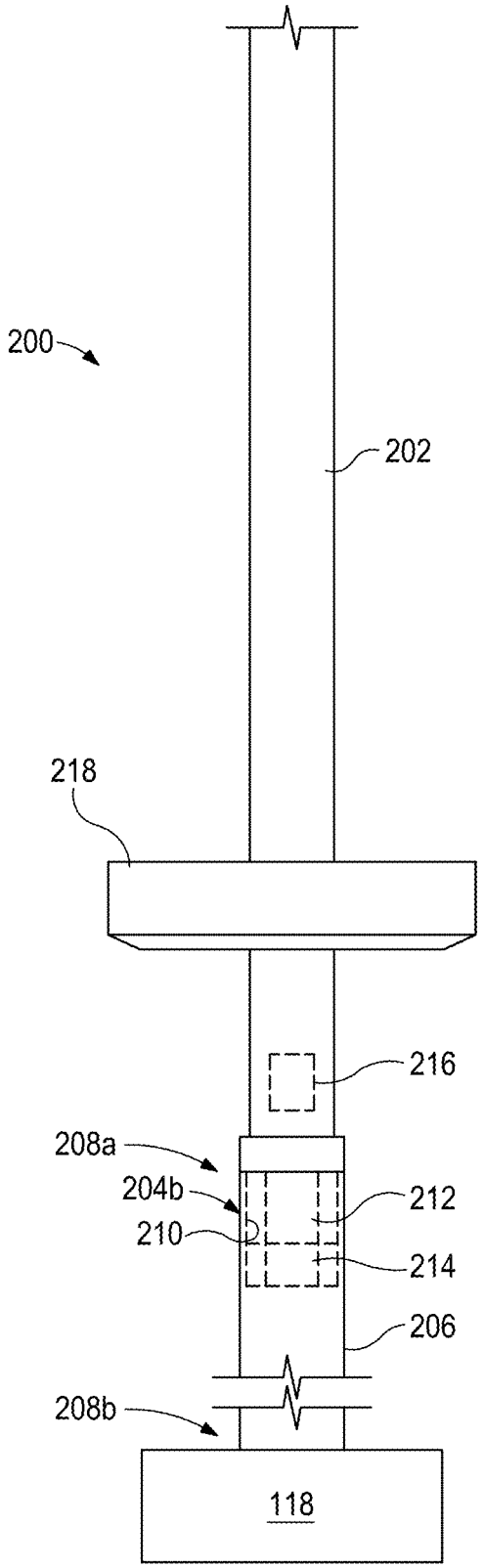
FIG. 2B is a schematic side view of the back pressure valve recovery tool operatively coupled to the back pressure valve retrieval tool, according to one or more embodiments.

FIG. 2B is a schematic side view of the BPV recovery tool 200 operatively coupled to the BPV retrieval tool 206, according to one or more embodiments. More specifically, in FIG. 2B, the matable feature 212 arranged at the lower end 204*b* of the BPV recovery tool 200 is shown received within the BPV retrieval tool 206 and, more specifically, within the internal profile 210.

In some embodiments, the matable feature 212 may form an integral part and extension of the body 202. In such embodiments, the matable feature 212 may be machined and otherwise defined at the lower end 204*b* to exhibit the geometry and characteristics necessary to properly locate and mate with the internal profile 210. In other embodiments, however, the matable feature 212 may comprise a separate component part operatively coupled to the lower end 204*b* of the body 202. In such embodiments, the matable feature 212 may be machined and designed separate from the BPV recovery tool 200 with the necessary geometry and characteristics for mating with the internal profile 210. Moreover, in such embodiments, the matable feature 212 may be operatively coupled to the lower end 204*b* via a variety of attachment means including, but not limited to, welding, mechanical fasteners, mechanical attachments, and adhesive, an interference fit, a shrink fit, or any combination thereof.

Referring to both FIGS. 2A and 2B, example operation of the BPV recovery tool 200 will now be provided. The BPV recovery tool 200 may be lowered into the wellhead 100 (FIG. 1) as coupled to the running tool and associated tool string. As the BPV recovery tool 200 is lowered, or just before reaching the broken section of the BPV retrieval tool 206, the BPV recovery tool 200 may be slowly rotated (e.g., either manually or hydraulically) via the running tool until the matable feature 212 locates and is received within the internal profile 210 provided within the upper end 208*a* of the BPV retrieval tool 206. Once the matable feature 212 is received within the internal profile 210, the BPV recovery tool 200 may be further rotated to separate the BPV retrieval tool 206 from the BPV 118. More specifically, rotating the BPV recovery tool 200 transfers torque from the BPV recovery tool 200 to the broken section of the BPV retrieval tool 206 via the mated interface between the internal profile 210 and the matable feature 212. The transferred torque helps loosen the attachment between the BPV retrieval tool 206 and the BPV 118, and further rotation of the BPV retrieval tool 206 may cause the lower end 208*b* of the BPV retrieval tool 206 to detach (e.g., unthread) and separate from the BPV 118.

In some embodiments, the lower end 204*b* of the BPV recovery tool 200 may exhibit magnetic properties operable to magnetically attract ferromagnetic materials. In at least one embodiment, for example, the matable feature 212 may comprise a magnet and may otherwise exhibit magnetic properties configured to magnetically attract the broken section of the BPV retrieval tool 206. In other embodiments, however, or in addition thereto, the BPV recovery tool 200 may further include a magnet 214 (FIG. 2B) coupled to or otherwise forming part of the lower end 204*b* of the body 202. Accordingly, after the BPV retrieval tool 206 is separated (unthreaded) from the BPV 118, magnetic attraction of the ferromagnetic material of the BPV retrieval tool 206 will allow the BPV recovery tool 200 to extract the broken section of the BPV retrieval tool 206 from the wellhead 100 (FIG. 1). As will be appreciated, and in contrast to conventional back pressure valve fishing operations, this enables the broken section of the BPV retrieval tool 206 and the BPV 118 to be retrieved in one run into the wellhead 100.

In embodiments that include the magnet 214, the magnet 214 may be operatively coupled to or form an integral part of the matable feature 212 at the lower end 204*b* of the body 202. The magnet 214 may be operatively coupled to the lower end 204*b* (e.g., the matable feature 212) via a variety of coupling means including, but not limited to, one or more mechanical fasteners, welding, soldering, an interference fit, a mechanical engagement, an adhesive, or any combination thereof. In some embodiments, the magnet 214 may exhibit a similar geometry as the matable feature 212. In such embodiments, the magnet 214 may exhibit a polygonal cross-section, such as a hexagonal cross-section as shown in FIG. 2D configured to mate with the corresponding cross-section of the internal profile 210. Moreover, in such embodiments, the magnet 214 may help transfer torque to the BPV retrieval tool 206 once received within the internal profile 210. In other embodiments, however, the magnet 214 may exhibit other geometries (e.g., circular), but nonetheless be sized to be able to be received within the internal profile 210.

The magnet 214 may comprise any type of known magnet including, but not limited to, a permanent magnet, an electromagnet, a paramagnetic material, or any combination thereof. In embodiments where the magnet 214 comprises an electromagnet, the BPV recovery tool 200 may further include an internal power source 216 configured to provide the necessary electrical power to operate the electromagnet. The power source 216 can include, for example, one or more batteries or fuel cells. In other embodiments, however, the internal power source 216 may be omitted and the electromagnet may instead be powered via a direct power line extending through the running to from a source of grid power or a generator. Moreover, in embodiments where the magnet 214 comprises an electromagnet, the electromagnet may be operated via remote or direct control, and may be automated or selectively operated by a user. Embodiments where the magnet 214 comprises an electromagnet may be advantageous since the magnet 214 may be operated only as needed, thus not attracting ferromagnetic materials until arranged adjacent the BPV retrieval tool 206.

In some embodiments, the BPV recovery tool 200 may further include a centralizer 218 operatively coupled to or forming an integral part of the body 202 between the upper and lower ends 204*a,b*. As illustrated, the centralizer 218 may exhibit a diameter that is greater than a diameter of the body 202, which allows the centralizer 218 to help guide the BPV recovery tool 200 within the wellhead 100 (FIG. 1). More specifically, the centralizer 218 may be configured to help guide the lower end 204*b* of the BPV recovery tool 200 into mated engagement with the upper end 208*a* of the BPV retrieval tool 206, thereby operatively coupling the BPV recovery tool 200 to the BPV retrieval tool 206. In some embodiments, for example, the centralizer 218 may be configured to engage inner walls of the wellhead 100 as the BPV recovery tool 200 is lowered into the wellhead 100. In at least one embodiment, the axial location of the centralizer 218 can be adjustable along the axial length of the body 202.

Figure 3:
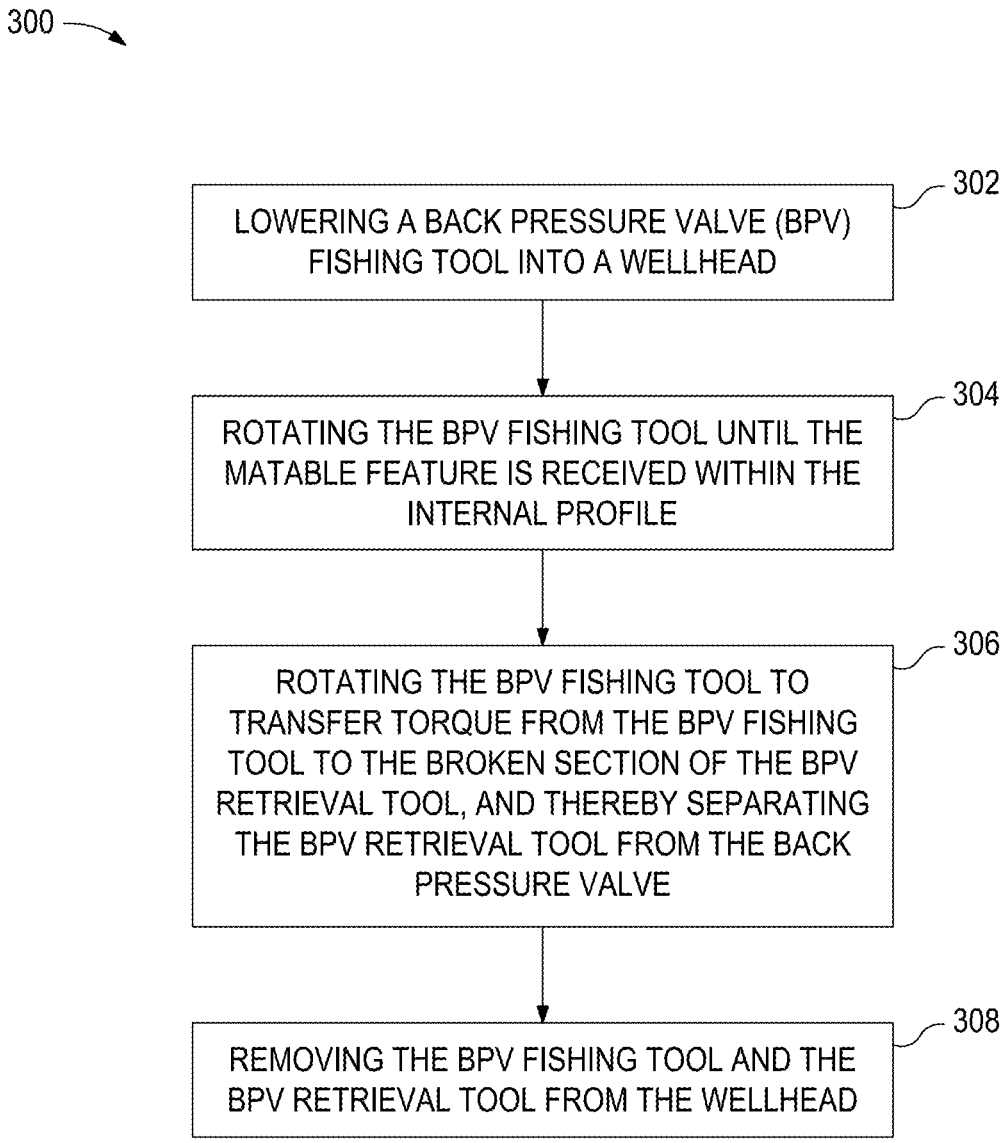
FIG. 3 is a method for retrieving the broken section of the back pressure valve retrieval tool using the back pressure valve fishing device.

FIG. 3 is a schematic flowchart of an example method 300 for retrieving a broken section of a back pressure valve (BPV) retrieval tool, such as the BPV retrieval tool 206 described herein. As illustrated, the method 300 includes lowering a back pressure valve (BPV) recovery tool into a wellhead, as at 302. The wellhead may have a back pressure valve installed therein and a broken section of the BPV retrieval tool may be received within the back pressure valve. Moreover, the BPV recovery tool may include an elongate, cylindrical body having opposing upper and lower ends, and a matable feature provided at the lower end and matable with an inner profile provided on an upper end of the broken section of the BPV retrieval tool. Upon reaching the broken section of the BPV retrieval tool, the method 300 may further include rotating the BPV recovery tool until the matable feature is received within the internal profile, as at 304. The method 300 may further include rotating the BPV recovery tool to transfer torque from the BPV recovery tool to the broken section of the BPV retrieval tool, and thereby separating the BPV retrieval tool from the back pressure valve, as at 306. The method 300 may also include removing the BPV recovery tool and the BPV retrieval tool from the wellhead, as at 308.

Therefore, the proposed BPV recovery tool 200 is designed as a specialized tool used in the oil and gas industry for retrieving a broken section of the BPV retrieval tool that has become lodged inside the BPV 118. The BPV recovery tool 200 includes the elongated body 202, which is designed for lowering and operating the BPV recovery tool 200. Moreover, the BPV recovery tool 200 includes the matable feature 212, which may exhibit a hexagonal cross-section configured to mate with a corresponding hexagonal cross-section of an internal profile provided by the broken section of the BPV retrieval tool. In some embodiments, the lower end of the BPV recovery tool 200 may exhibit magnetic properties, which ensures secure engagement and retrieval of the broken tool. The magnetic properties of the BPV recovery tool 200 attract the broken section of the BPV retrieval tool, to pull out the broken BPV retrieval tool. The BPV recovery tool 200 can eliminate and reduce the need for large and expensive milling jobs for retrieving the broken section of the BPV retrieval tool.

The BPV recovery tool 200 provides faster retrieval process of lost tools compared to milling, thereby saving time and money, and improving efficiency. The BPV recovery tool 200 restores full accessibility for well control and securement, and provides clear path for BPV operation. The BPV recovery tool 200 provides simple installation on any of the shelf BPV string. The BPV recovery tool 200 does not require special pressure control equipment. Further, the same BPV operation set is required. Thus, the proposed BPV recovery tool 200 saves resources and minimizes disruption to operations and could be considered as a leading retrieving method to enhance one of the oil/gas field applications.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

The use of directional terms such as above, below, upper, lower, upward, downward, left, right, up-hole, downhole and the like are used in relation to the illustrative embodiments as they are depicted in the figures, the upward direction being toward the top of the corresponding figure and the downward direction being toward the bottom of the corresponding figure, the up-hole direction being toward the surface of the well and the downhole direction being toward the toe of the well.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A back pressure valve recovery tool, comprising:

an elongate, cylindrical body having opposing upper and lower ends; and a matable feature provided at the lower end and matable with an inner profile provided on an upper end of a broken section of a back pressure valve (BPV) retrieval tool, wherein the matable feature exhibits a hexagonal cross-section and the internal profile exhibits a corresponding hexagonal cross-section sized to receive the matable feature, and wherein the broken section of the BPV retrieval tool is received within a back pressure valve installed within a wellhead.

2. The back pressure valve recovery tool claim 1, wherein the matable feature forms an integral part and extension of the body.

3. The back pressure valve recovery tool claim 1, wherein the matable feature comprises a separate component part operatively coupled to the lower end of the body.

4. The back pressure valve recovery tool claim 1, wherein the lower end exhibits magnetic properties operable to magnetically attract the broken section of the BPV retrieval tool.

5. The back pressure valve recovery tool claim 4, wherein the matable feature comprises a magnet configured to magnetically attract the broken section of the BPV retrieval tool.

6. The back pressure valve recovery tool claim 4, further comprising a magnet attached to the lower end and configured to magnetically attract the broken section of the BPV retrieval tool.

7. The back pressure valve recovery tool claim 6, wherein the magnet exhibits a similar geometry as the matable feature and is matable with the internal profile.

8. The back pressure valve recovery tool claim 6, wherein the magnet is selected from the group consisting of a permanent magnet, an electromagnet, a paramagnetic material, and any combination thereof.

9. The back pressure valve recovery tool claim 1, further comprising a centralizer provided on the body at a location between the upper and lower ends, the centralizer being operable to centralize the body within the wellhead and thereby guide the matable feature into the internal profile.

10. A method for retrieving a broken section of a back pressure valve (BPV) retrieval tool, comprising:

lowering a back pressure valve (BPV) recovery tool into a wellhead having a back pressure valve installed therein and a broken section of the BPV retrieval tool received within the back pressure valve, the BPV recovery tool including:

an elongate, cylindrical body having opposing upper and lower ends; and a matable feature provided at the lower end and matable with an inner profile provided on an upper end of the broken section of the BPV retrieval tool;

upon reaching the broken section of the BPV retrieval tool, rotating the BPV recovery tool until the matable feature is received within the internal profile;

rotating the BPV recovery tool to transfer torque from the BPV recovery tool to the broken section of the BPV retrieval tool, and thereby separating the BPV retrieval tool from the back pressure valve; and removing the BPV recovery tool and the BPV retrieval tool from the wellhead.

11. The method of claim 10, wherein the matable feature exhibits a hexagonal cross-section and the internal profile provides a corresponding hexagonal cross-section sized to receive the matable feature.

12. The method of claim 10, further comprising magnetically attracting the broken section of the BPV retrieval tool to the lower end of the BPV recovery tool.

13. The method of claim 12, wherein the BPV recovery tool further includes a magnet attached to the lower end, and wherein magnetically attracting the broken section of the BPV retrieval tool to the lower end of the BPV recovery tool comprises magnetically attracting the broken section of the BPV retrieval tool to the magnet.

14. The method of claim 10, further comprising centralizing the body within the wellhead with a centralizer provided on the body at a location between the upper and lower ends and thereby guiding the matable feature into the internal profile.

15. The back pressure valve recovery tool of claim 6, wherein the magnet is either a permanent magnet or an electromagnet.

16. A back pressure valve recovery tool, comprising:

an elongate, cylindrical body having opposing upper and lower ends;

a magnet attached to the lower end and configured to magnetically attract a broken section of a back pressure valve (BPV) retrieval tool; and a matable feature provided at the lower end and matable with an inner profile provided on an upper end of the broken section of the BPV retrieval tool, wherein the broken section of the BPV retrieval tool is received within a back pressure valve installed within a wellhead.

17. The back pressure valve recovery tool claim 16, wherein the magnet is either a permanent magnet or an electromagnet.

18. The back pressure valve recovery tool claim 16, wherein the matable feature exhibits a hexagonal cross-section and the magnet exhibits a hexagonal cross-section, and wherein the internal profile provides a corresponding hexagonal cross-section sized to receive the matable feature and the magnet.

19. The back pressure valve recovery tool of claim 16, wherein the magnet is formed from a paramagnetic material.

* * * * *